United States Patent [19]

Watson

[11] 4,382,302

[45] May 10, 1983

[54] WEIGHTED TRAINING VEST HAVING CONSTANT WEIGHT DISTRIBUTION

[76] Inventor: Douglas E. Watson, 3665 SE. Monroe St., Apt. #8, Milwaukie, Oreg. 97222

[21] Appl. No.: 249,171

[22] Filed: Mar. 30, 1981

[51] Int. Cl.[3] ..... A41D 1/04; A63B 21/12

[52] U.S. Cl. ..... 2/102; 272/119

[58] Field of Search ..... 2/102, 2, 2.5; 272/119, 272/70

[56] References Cited

U.S. PATENT DOCUMENTS

| | | | |
|---|---|---|---|
| 1,749,714 | 3/1930 | North | 2/102 |
| 3,532,339 | 10/1970 | Smith | 272/119 |
| 4,106,121 | 8/1978 | Belson | 2/102 |
| 4,288,917 | 5/1981 | Massey | 2/102 |

FOREIGN PATENT DOCUMENTS

| | | | |
|---|---|---|---|
| 218063 | 7/1967 | Sweden | 272/119 |

*Primary Examiner*—Doris L. Troutman

*Attorney, Agent, or Firm*—Chernoff, Vilhauer, McClung, Birdwell & Stenzel

[57] ABSTRACT

A weighted training vest device adapted to be worn upon an athlete's torso to develop greater strength for running. The vest includes front and rear flexible panels adapted to fit against the wearer's chest and back respectively and a plurality of weights adapted to be affixed to such panels selectively and individually in a predetermined pattern. The panels are sufficiently rigid to maintain the pattern of the weights substantially constant during running by resisting the tendency of the weights to move relative to each other as a result of the dynamic forces imposed by running. The panels also have resilient, slip-resistant interior surfaces to prevent relative movement between the panels and the wearer's skin during running so as to further prevent movement of the weights relative to the wearer's body. The weight patterns on the front and rear panels are substantially identical, horizontally-symmetrical patterns, and each of the weights is detachably affixed to the panels separately so that the weights may be added or removed individually in accordance with the wearer's training level without adversely affecting the balance of the vest.

9 Claims, 4 Drawing Figures

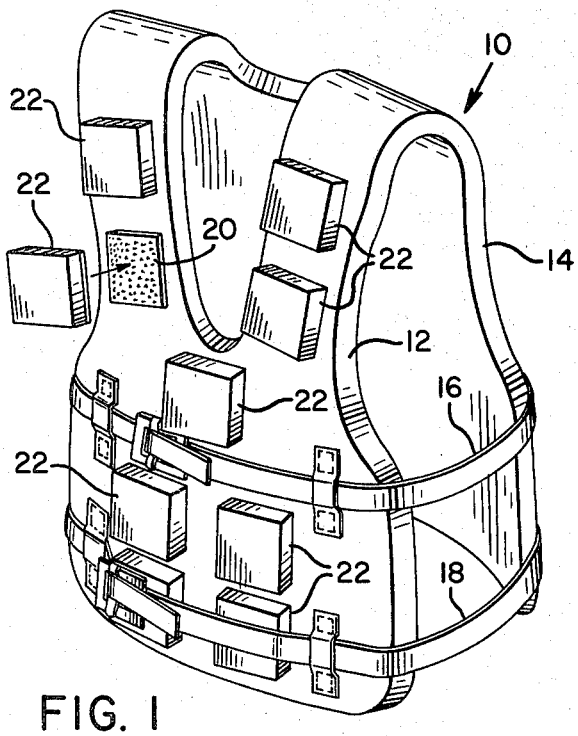
FIG. 1
FIG. 4
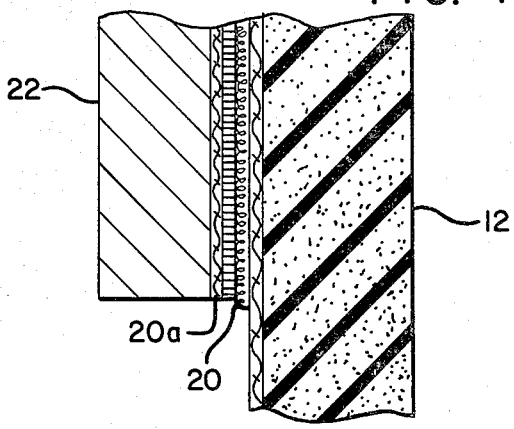
FIG. 3
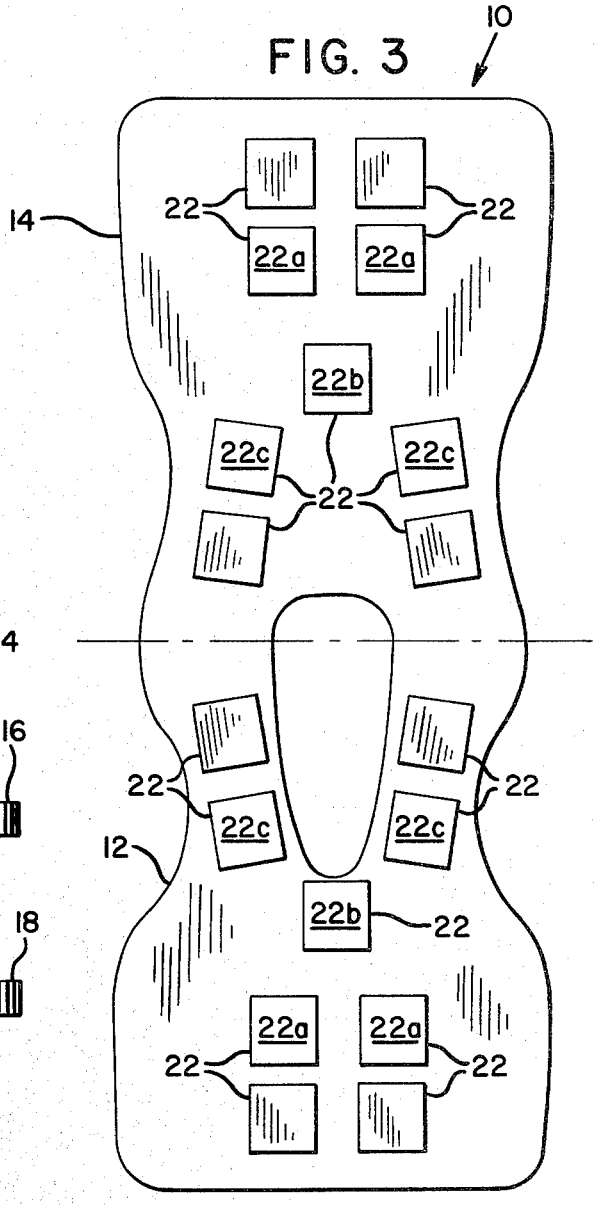
FIG. 2
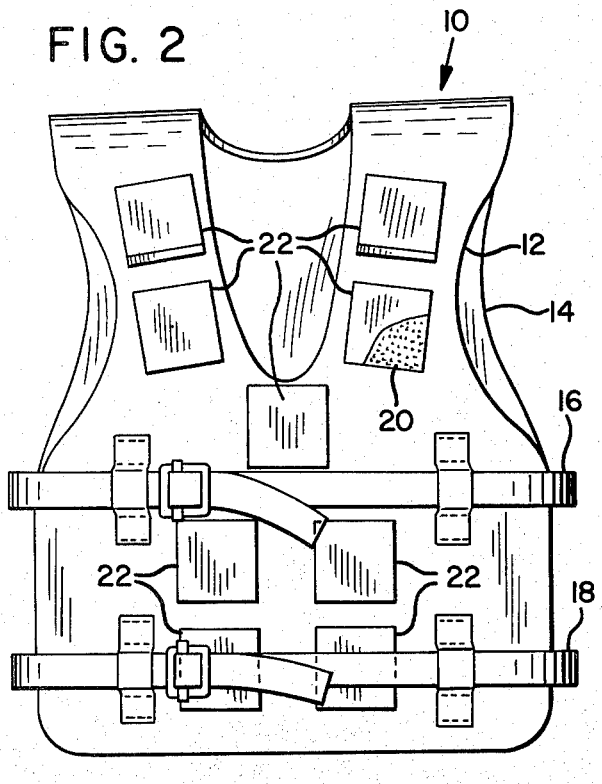

WEIGHTED TRAINING VEST HAVING CONSTANT WEIGHT DISTRIBUTION

BACKGROUND OF THE INVENTION

This invention relates to improvements in training devices for athletes, and particularly to weighted devices adapted to be worn by the athlete to increase his running strength, speed and endurance.

To develop greater speed and endurance in running, an athlete should concern himself with strengthening the primary muscles of the thigh (quadriceps). These muscles are the power source for forward motion. An increase in thigh strength will produce a longer stride length and an ability to push through a given resistance more quickly, both of which increase the running speed of the athlete.

The relative degree of muscle strengthening which occurs during an athlete's training depends on the resistance which these muscles meet. The resistance imposed upon thigh muscles is the body weight of the athlete in the area above the thigh. Accordingly any increase in body weight by means of weighted training devices, to impose more resistance on these muscles and thereby strengthen them, must occur above the thigh muscles to be worked, i.e. above the waist area. For this reason ankle-mounted weighted training devices, such as that shown in U.S. Pat. No. 2,241,833, or thigh-mounted weighted training devices, such as that shown in U.S. Pat. No. 4,180,261, are inadequate for this purpose.

Conventional methods of weight training to strengthen these muscles (leg squats, leg presses, etc.), are confined movements that work a local group of muscles. As a result, an imbalance in muscle strength is created and the chance of injury increases. The hamstrings (opposing muscles of the quadriceps) are the muscles that sprinters commonly pull or tear when this imbalance is created.

What is needed therefore is a specialized training device that will strengthen the thigh muscles, as well as all of the other muscles that will be involved in running such as leg, ankle and foot muscles. This strengthening must be accomplished while the athlete is running to provide a balanced increase in muscle strength, and must be provided by increasing body weight, and thus muscle resistance, in the area above the waist.

While weighted training vests have, in the past, been used to impose increased muscle resistance above the waist and thereby strengthen the thigh muscles as well as the other muscles involved in running, such vests have suffered from several severe deficiencies which discourage most athletes from using them. A primary problem in this regard is that the weights carried by the vest bounce around dynamically while the athlete is running, thereby constituting a source of aggravation and distraction and destroying the athlete's rhythm and balance of movement. This disadvantage in itself would discourage must runners from using such weighted vests, and is even more of a drawback for specialized runners such as basketball players whose fine control of balance while running is especially critical. Tightening the vest on the body to the point where dynamic movement of the weights is minimized is impossible because such tightening would interfere with the runner's breathing. An exemplary weighted training vest of the type having such drawbacks is shown in British Pat. No. 5960 wherein a cloth vest contains metal weights.

Although more recently cloth training vests having sand sewn into special pockets have been employed, such modern training vests continue to share the aforementioned drawbacks of dynamic weight movement which discourage their widespread use.

Muscle resistance provided by a weighted training vest should be variable in progressive and controlled increments as the athlete's muscle strength develops. Furthermore such incremental weight increases should be obtainable in a balanced fashion, such that the training device does not become appreciably heavier in the front than in the rear or heavier on one side than the other. These capabilities are also beyond those of conventional weighted training vests.

SUMMARY OF THE PRESENT INVENTION

The present invention overcomes all of the aforementioned drawbacks of prior weighted training devices by providing a vest adapted to be worn upon an athlete's torso with front and rear flexible panels to which a plurality of weights may be selectively detachably affixed individually in accordance with a predetermined spaced-apart pattern. The panels are sufficiently rigid so as to maintain the spacing between the respective weights constant while the athlete is in the act of running so that the weights cannot bounce around dynamically and change position with respect to one another as they would normally do under the influence of the runner's dynamic forces if they were mounted on or in a less rigid material. This maintenance of the individual weights in a predetermined relation to each other and to the runner's body is further enhanced by the fact that the vest is provided with a resilient interior surface which tends to adhere frictionally to the athlete's skin and prevent slippage between the vest panels and the runner's body. This combination of features virtually eliminates all dynamic movement of the weights relative to the runner's body, and does so without requiring such a snug fit of the vest on the body as to impair the runner's ability to breathe.

Preferably the material from which the front and rear vest panels are constructed to provide the desired flexible, yet semirigid, construction and a resilient, slip-resistant interior surface is a molded polyurethane foam material.

Incremental variation of the weight of the vest without thereby causing undue imbalance thereof is provided by equipping both the front and rear vest panels with substantially identical, horizontally-symmetrical patterns of attaching members for detachably affixing weights thereto. Preferably the attaching members comprise mating pieces of curly pile loop and hook fastener material arranged in the aforementioned pattern on the vest panels and affixed to the weights. These substantially identical, horizontally symmetrical patterns on the front and rear panels make it possible, for example, to add a single weight to the front panel and then, when it is desired to increase the weight, to add a similar weight in an oppositely-corresponding position on the rear panel. In this way both front and rear balance, and side balance, can be preserved as the weight of the vest is gradually increased.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a partially exploded perspective view of an exemplary embodiment of the weighted training vest of the present invention.

FIG. 2 is a front view of the vest of FIG. 1.

FIG. 3 is a top view of the vest of FIG. 1 with the front and rear panels thereof extended flat with respect to each other.

FIG. 4 is a cross-sectional enlarged detail view of the detachable weight-mounting structure of the vest of FIG. 1.

DESCRIPTION OF THE PREFERRED EMBODIMENT

The weighted training vest of the present invention, indicated generally as 10, comprises a front panel 12 and rear panel 14 joined at the shoulders so that the two panels can preferably be formed as a single piece of flexible material in a shape as best seen in FIG. 3. The preferable material from which the panels are formed is molded polyurethane foam, approximately ¾ inch in thickness, because of such material's lightness, its flexible yet semirigid nature and its resilient slip-proof surfaces.

As best seen in FIGS. 1 and 2, adjustable tightening straps 16 and 18 respectively are provided interconnecting the front and rear panels 12 and 14 so as to hold the panels snugly in contact with the wearer's chest and back while the device is being worn. Such straps would not, however, be tightened to such degree as to inferfere with the wearer's breathing while running.

Each of the panels 12 and 14 respectively has a plurality of weight-attaching members 20 affixed to the exterior surface thereof for detachably affixing weights 22 individually. The weight-attaching members 20 are spaced apart from one another by respective predetermined distances according to a respective horizontally-symmetrical pattern on each panel. As best seen in FIG. 3, such patterns on the respective panels 12 and 14 are substantially identical to each other. Preferably the weight-attaching members 20 comprise patches of material of the curly pile loop and hook self-gripping fastener type sold under the trademark VELCRO. Patches of either hook or loop material may be mounted on the surfaces of the panels 12 and 14, with corresponding patches of the mating fastener material 20*a* mounted upon the backs of the respective weights 22 as best seen in FIG. 4. Such weight-attaching structure provides a very reliable means of securely affixing the weights 22 to the panels 12 and 14 and effectively resists any inadvertent dislodgment of the weights even when subjected to the dynamic forces of running, despite the fact that the weights are constructed of metal (preferably lead) and weigh about one pound each, thereby having a total weight far more than that of the panel to which they are attached. Despite such secure attachment, however, the weights may be quickly and easily attached or detached individually for the purposes to be described more fully hereafter.

In use, the training vest 10 is strapped to the athlete's torso by the straps 16 and 18 so that the panels 12 and 14 are snug against the wearer's chest and back but do not impair his breathing while running. Preferably the athlete wears the vest in contact with the skin of his back and chest, since this takes advantage of the slip-resistance of the resilient interior surfaces of the vest panels 12 and 14 which resist movement of the vest panels relative to the athlete's body.

If the athlete is in an early stage of training, perhaps only a few weights would be attached to the front and rear panels respectively. These should be attached in a balanced fashion with respect to front and rear such that the two panels 12 and 14 contain equal numbers of weights 22. Moreover the weights should be distributed in a balanced fashion from side-to-side such that there are equal numbers of weights on the right and left sides of the vest respectively. For example, four weights 22 might be mounted on the vest 10 occupying the four positions 22*a* as shown in FIG. 3. This would provide a fully balanced weight system. As the athlete's training advances, two more weights could be added to the vest in the two locations 22*b* respectively, which would preserve the front-to-rear and side-to-side balance of the vest. The addition of another two weights could be accomplished by placing the additional weights at two of the four positions 22*c*, and moving two weights from positions 22*b* to the other two positions 22*c* to maintain balance. Thereafter, when two further weights are later added, they would occupy the now-vacant positions 22*b*. Weights may be added to or subtracted from the vest 10 in increments of two in such manner without adversely affecting either front-to-rear or side-to-side balance thereof. This result is obtainable primarily as a result of the horizontal symmetry of the weight-attaching patterns and the fact that such patterns are provided on both the front and rear vest panels.

With the weights 22 attached to the vest in the manner described, the athlete may engage in general running activities, or specialized running activities such as playing basketball or soccer, and thereby strengthen the thigh muscles and other runnng muscles in a balanced fashion. During such activity, the weights 22 are prevented from moving with respect to each other, despite the dynamic forces to which they are subjected, by virtue of the rigidity of the polyurethane foam material from which the panels 12 and 14 are constructed. Moreover the vest, and thus the weights, are substantially prevented from moving with respect to the athlete's body by means of the slip-resistance of the interior surfaces of the vest with respect to the athlete's skin. Thus the dynamic movement of the weights 22 relative to the body, which has previously discouraged the use of such weighted training vests, is substantially eliminated.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An athletic training vest device adapted to be worn upon an athlete's torso while running, said device comprising:

(a) respective front and rear flexible panels adapted to fit against the wearer's chest and back respectively;

(b) interconnecting means extending between said front and rear panels for holding said panels snugly in contact with the wearer's chest and back respectively;

(c) a first plurality of weights affixed to said front panel at respective locations spaced apart from one another by respective predetermined distances and having a total weight greater than that of said front panel, and a second plurality of weights affixed to said rear panel at respective locations spaced apart from one another by respective predetermined distances and having a total weight greater than that of said rear panel;

(d) each of said flexible panels including rigidifying means other than said interconnecting means for maintaining the respective predetermined distances between the weights on the respectve panel substantially constant while the wearer of the training vest device is in the act of running, said rigidifying means comprising substantially rigid material extending between the weights on the respective panel and capable of resisting dynamic movement of the weights with respect to one another.

2. An athletic training vest device adapted to be worn upon an athlete's torso while running, said device comprising:

(a) respective front and rear flexible panels adapted to fit against the wearer's chest and back respectively;

(b) interconnecting means extending between said front and rear panels for holding said panels snugly in contact with the wearer's chest and back respectively;

(c) a first plurality of weights affixed to said front panel at respective locations spaced apart from one another by respective predetermined distances and having a total weight greater than that of said front panel, and a second plurality of weights affixed to said rear panel at respective locations spaced apart from one another by respective predetermined distances and having a total weight greater than that of said rear panel;

(d) each of said flexible panels having interior surfaces adapted to contact the wearer's chest and back respectively, said interior surfaces comprising slip-resistant resilient means for adhering frictionally to the wearer's skin and thereby resisting relative slippage between said interior surfaces and the wearer's skin.

3. An athletic training vest device adapted to be worn upon an athlete's torso while running, said device comprising:

(a) respective front and rear flexible panels adapted to fit against the wearer's chest and back respectively;

(b) interconnecting means extending between said front and rear panels for holding said panels snugly in contact with the wearer's chest and back respectively;

(c) a first plurality of weights affixed to said front panel at respective locations spaced apart from one another by respective predetermined distances and having a total weight greater than that of said front panel, and a second plurality of weights affixed to said rear panel at respective locations spaced apart from one another by respective predetermined distances and having a total weight greater than that of said rear panel;

(d) each of said flexible panels including stabilizing means other than said interconnecting means for minimizing dynamic relative movement of the weights on the respective panel with respect to one another and with respect to the wearer's body, each of said panels being constructed of a substantially rigid material, extending between the weights on the respective panel, capable of resisting dynamic movement of the weights with respect to one another and having a slip-resistant resilient interior surface capable of adhering frictionally to the wearer's skin.

4. The device of any one of claims 1, 2 or 3 including mutually-cooperative means on the surfaces of said panels and on said weights for detachably affixing said weights individually to the surfaces of said panels.

5. The device of claim 4 wherein said mutually-cooperative means comprises mating pieces of curly pile loop and hook fastener material attached to the surfaces of said panels and to said weights respectively.

6. The device of claim 1, said panels further including slip-resistant resilient means on the interior surfaces thereof for adhering frictionally to the skin of the wearer's chest and back respectively and thereby resisting relative slippage between said surfaces and the wearer's skin.

7. The device of claim 2 wherein each of said flexible panels includes rigidifying means other than said interconnecting means for maintaining the respective predetermined distances between the weights on the respective panel substantially constant while the wearer of the training device is in the act of running, said rigidifying means comprising substantially rigid material extending between the weights on the respective panel and capable of resisting dynamic movement of the weights with respect to one another.

8. The device of claim 1, 2 or 3 wherein said first and second pluralities of weights respectively are arranged in respective horizontally-symmetrical patterns on said front and rear panels respectively, further including means for detachably affixing each of said weights individually to said panels so as to permit said weights individually to be selectively added to or excluded from said patterns.

9. The device of any one of claims 1, 2 or 3 wherein said front and rear panels comprise molded polyurethane foam panels.

* * * * *